US007503326B2

(12) United States Patent
Martin

(10) Patent No.: US 7,503,326 B2
(45) Date of Patent: Mar. 17, 2009

(54) FILTERING FACE MASK WITH A UNIDIRECTIONAL VALVE HAVING A STIFF UNBIASED FLEXIBLE FLAP

(75) Inventor: Philip G. Martin, Forest Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 649 days.

(21) Appl. No.: 11/275,299

(22) Filed: Dec. 22, 2005

(65) Prior Publication Data

US 2007/0144524 A1 Jun. 28, 2007

(51) Int. Cl.
*A62B 9/02* (2006.01)

(52) U.S. Cl. ..... 128/205.24; 128/207.12

(58) Field of Classification Search ..... 128/203.11, 128/205.24, 206.15, 207.16; 137/855–858
See application file for complete search history.

(56) References Cited

U.S. PATENT DOCUMENTS

| | | | |
|---|---|---|---|
| 2,895,472 | A | 7/1959 | Matheson |
| RE28,102 | E | 8/1974 | Mayhew |
| 4,215,682 | A | 8/1980 | Kubik et al. |
| 4,419,993 | A | 12/1983 | Petersen |
| 4,536,440 | A | 8/1985 | Berg |
| 4,592,815 | A | 6/1986 | Nakao |
| 4,630,604 | A | 12/1986 | Montesi |
| 4,790,306 | A | 12/1988 | Braun et al. |
| 4,807,619 | A | 2/1989 | Dyrud et al. |
| 4,827,924 | A | 5/1989 | Japuntich |
| 4,850,347 | A | 7/1989 | Skov |
| 4,874,399 | A | 10/1989 | Reed et al. |
| 4,934,362 | A | 6/1990 | Braun |
| 5,025,052 | A | 6/1991 | Crater et al. |
| 5,035,239 | A | 7/1991 | Edwards |

(Continued)

FOREIGN PATENT DOCUMENTS

| | | | |
|---|---|---|---|
| GB | 2 072 516 | A | 10/1981 |

(Continued)

OTHER PUBLICATIONS

ASTM D412-98a, "Standard Test Methods for Vulcanized Rubber and Thermoplastic Elastomers—Tension," Annual Book of ASTM Standards, vol. 03.01, pp. 44-57., no date.

(Continued)

*Primary Examiner*—Steven O Douglas
(74) *Attorney, Agent, or Firm*—Karl G. Hanson

(57) ABSTRACT

A filtering face mask that includes a mask body that is adapted to fit at least over the nose and mouth of a wearer to create an interior gas space when worn; and an exhalation valve that is in fluid communication with the interior gas space. The exhalation valve includes a valve seat with a seal surface and an orifice through which exhaled air may pass to leave the interior gas space; and a flexible flap that is mounted to the valve seat such that the flap makes contact with the seal surface when the valve is in its closed position and such that the flap can flex away from the seal surface during an exhalation to allow exhaled air to pass through the orifice. The flap is unbiased when in its closed position and exhibits a cantilever bend ratio of 0.0050 or less.

21 Claims, 2 Drawing Sheets

U.S. PATENT DOCUMENTS

| | | | |
|---|---|---|---|
| 5,062,421 | A | 11/1991 | Burns et al. |
| 5,099,026 | A | 3/1992 | Crater et al. |
| 5,307,796 | A | 5/1994 | Kronzer et al. |
| 5,325,892 | A | 7/1994 | Japuntich et al. |
| 5,394,568 | A | 3/1995 | Brostrom et al. |
| 5,411,576 | A | 5/1995 | Jones et al. |
| 5,464,010 | A | 11/1995 | Byram |
| 5,472,481 | A | 12/1995 | Jones et al. |
| 5,496,507 | A | 3/1996 | Angadjivand et al. |
| 5,509,436 | A | 4/1996 | Japuntich et al. |
| 5,558,089 | A | 9/1996 | Castiglione |
| 5,579,761 | A | 12/1996 | Yuschak et al. |
| 5,671,849 | A | 9/1997 | Bacon |
| 5,687,767 | A | 11/1997 | Bowers |
| 5,706,804 | A | 1/1998 | Baumann et al. |
| 5,908,598 | A | 6/1999 | Rousseau et al. |
| 5,924,420 | A | 7/1999 | Reischel et al. |
| D412,573 | S | 8/1999 | Castiglione |
| 6,041,782 | A | 3/2000 | Angadjivand et al. |
| 6,047,698 | A | 4/2000 | Magidson et al. |
| D424,688 | S | 5/2000 | Bryant et al. |
| 6,055,983 | A | 5/2000 | Metzger |
| 6,057,256 | A | 5/2000 | Krueger et al. |
| 6,062,221 | A | 5/2000 | Brostrom et al. |
| 6,068,799 | A | 5/2000 | Rousseau et al. |
| 6,123,077 | A | 9/2000 | Bostock et al. |
| D431,647 | S | 10/2000 | Henderson et al. |
| 6,125,849 | A | 10/2000 | Williams et al. |
| 6,158,429 | A | 12/2000 | Gardner et al. |
| 6,213,122 | B1 | 4/2001 | Rousseau et al. |
| 6,216,693 | B1 | 4/2001 | Rekow et al. |
| 6,238,466 | B1 | 5/2001 | Rousseau et al. |
| D443,927 | S | 6/2001 | Chen |
| RE37,974 | E | 2/2003 | Bowers |
| 6,843,248 | B2 | 1/2005 | Japuntich et al. |
| 6,854,463 | B2 | 2/2005 | Japuntich et al. |
| 6,883,518 | B2 | 4/2005 | Mittelstadt et al. |
| 7,028,689 | B2 * | 4/2006 | Martin et al. ..... 128/205.24 |
| 2002/0195109 | A1 | 12/2002 | Mittelstadt et al. |
| 2004/0255947 | A1 | 12/2004 | Martin et al. |
| 2005/0061327 | A1 | 3/2005 | Martin et al. |

FOREIGN PATENT DOCUMENTS

| | | | |
|---|---|---|---|
| WO | WO 00/01737 | A1 | 1/2000 |
| WO | WO 01/28634 | A1 | 4/2001 |

OTHER PUBLICATIONS

ASTM D638-01, "Standard Test Method for Tensile Properties of Plastics," Annual Book of ASTM Standards, vol. 03.01, pp. 45-57, no date.

ASTM D747-99, "Standard Test Method for Apparent Bending Modulus of Plastics by Means of a Cantilever Beam," Annual Book of ASTM Standards, vol. 14.02, pp. 123-128, no date.

ASTM E111-97, "Standard Test Method for Young's Modulus, Tangent Modulus, and Chord Modulus," Annual Book of ASTM Standards, vol. 03.01, pp. 222-228, no date.

Davies, "The Separation of Airborne Dust and Particles," Institutions of Mechanical Engineers, London, *Proceedings 1B*, 1952, pp. 185-198.

Wente, "Superfine Thermoplastic Fibers," *Industrial and Engineering Chemistry*, 1956, vol. 48:1342-1346.

Wente et al., *Manufacture of Superfine Organic Fibers Report No. 4364 of the Naval Research Laboratories*, published May 25, 1954 (18 pgs).

* cited by examiner

FILTERING FACE MASK WITH A UNIDIRECTIONAL VALVE HAVING A STIFF UNBIASED FLEXIBLE FLAP

The present invention pertains to a filtering face mask that uses a stiff, unbiased flexible flap as the dynamic mechanical element in an exhalation valve and/or an inhalation valve.

Persons who work in polluted environments commonly wear a filtering face mask to protect themselves from inhaling airborne contaminants. Filtering face masks typically have a fibrous or sorbent filter that is capable of removing particulate and/or gaseous contaminants from the air. When wearing a face mask in a contaminated environment, wearers are comforted with the knowledge that their health is being protected, but they are, however, contemporaneously discomforted by the warm, moist, exhaled air that accumulates around their face. The greater this facial discomfort is, the greater the chances are that wearers will remove the mask from their face to alleviate the unpleasant condition.

To reduce the likelihood that a wearer will remove the mask from their face in a contaminated environment, manufacturers of filtering face masks often install an exhalation valve on the mask body to allow the warm, moist, air to be rapidly purged from the mask interior. The rapid removal of the exhaled air makes the mask interior cooler, and, in turn, benefits worker safety because mask wearers are less likely to remove the mask from their face to eliminate the hot moist environment that is located around their nose and mouth.

For many years, commercial respiratory masks have used "button-style" exhalation valves to purge exhaled air from mask interiors. The button-style valves typically have employed a thin circular flexible flap as the dynamic mechanical element that lets exhaled air escape from the mask interior. The flap is centrally mounted to a valve seat through a central post. Examples of button-style valves are shown in U.S. Pat. Nos. 2,072,516, 2,230,770, 2,895,472, and 4,630,604. When a person exhales, a circumferential portion of the flap is lifted from the valve seat to allow air to escape from the mask interior.

Button-style valves have represented an advance in the attempt to improve wearer comfort, but investigators have made other improvements, an example of which is shown in U.S. Pat. No. 4,934,362 to Braun. The valve described in this patent uses a parabolic valve seat and an elongated flexible flap. Like the button-style valve, the Braun valve also has a centrally-mounted flap and has a flap edge portion that lifts from a seal surface during an exhalation to allow the exhaled air to escape from the mask interior.

After the Braun development, another innovation was made in the exhalation valve art by Japuntich et al.—see U.S. Pat. Nos. 5,325,892 and 5,509,436. The Japuntich et al. valve uses a single flexible flap that is mounted off-center in cantilevered fashion to minimize the exhalation pressure that is required to open the valve. When the valve-opening pressure is minimized, less power is required to operate the valve, which means that the wearer does not need to work as hard to expel exhaled air from the mask interior when breathing.

Other valves that have been introduced after the Japuntich et al. valve also have used a non-centrally mounted cantilevered flexible flap—see U.S. Pat. Nos. 5,687,767 (reissued as U.S. Reissue Pat. No. RE37,974 E) and 6,047,698. Cantilevered valves that have this kind of construction are sometimes referred to as "flapper-style" exhalation valves.

Unidirectional valve assemblies such as those described above typically use biased or preloaded elastomeric diaphragms that seal against rigid valve seats. Biasing the valve flaps may, however, result in permanent deformation or creep.

Creep (permanent deformation that occurs in response to deformation over time) may be more prominent in valves that are used in respiratory masks that are stored for longer periods of time, e.g., years. Although many respiratory masks designed for industrial use are used within a relatively short period of time after they are manufactured, some respiratory masks may be purchased and stored for longer periods of time. For example, respiratory masks may be purchased and stored for use by emergency personnel (sometimes referred to as "first responders"). Respiratory masks purchased for such first responders may be stored for years before being used. If the valve flaps in such respiratory masks are biased, creep may reduce the force that the valve flaps exert against the seal surface of the valve.

As discussed in US Patent Application Publication No. US 2004/0255947, some respiratory mask valves may include resilient seal surfaces to enhance their ability to seal a valve opening (even when used with an unbiased valve flap). In another variation of valves used in connection with respiratory masks, US Patent Application Publication No. 2005/0061327 describes multi-layer valve flaps that incorporate resilient material on the surface of the valve flap facing the valve seal surface to enhance closure of the valve. The resilient materials used in the valve seats and valve flaps of those respiratory masks may, however, harden such that that they lose their resiliency if stored for longer periods of time (as might occur for respiratory masks used by first responders). That hardening or loss in resiliency may be accelerated if the respiratory masks are stored under harsher conditions, such as in emergency vehicles, etc., where temperature variations may exceed those normally experienced in more controlled environments (such as human-occupied buildings). That hardening may reduce the ability of the valves to seal when used.

SUMMARY OF THE INVENTION

The present invention provides a new filtering face mask, which in brief summary, comprises: (a) a mask body that is adapted to fit at least over the nose and mouth of a wearer to create an interior gas space when worn; and (b) an exhalation valve that is in fluid communication with the interior gas space. The exhalation valve comprises: (i) a valve seat that includes a rigid seal surface and an orifice through which exhaled air may pass to leave the interior gas space; and (ii) a flexible flap that is mounted to the valve seat such that the flap makes contact with the seal surface when the valve is in its closed position and such that the flap can flex away from the seal surface during an exhalation to allow exhaled air to pass through the orifice. The flap is unbiased when in its closed position and may preferably exhibit a cantilever bend ratio of about 0.0050 or less.

The filtering face mask of the present invention differs from known respiratory masks by providing its exhalation valve with a relatively stiff, unbiased valve flap in combination with a rigid valve seat. The stiffness of the valve flap preferably prevents the valve flap from falling away from the valve seat and leaking under, e.g., the force of gravity. Because the valve flap is unbiased, the actuation power, i.e., the power needed to open the valve during exhalation, may preferably be reduced as compared to valves with flaps of the same material that are biased against the valve seat.

In some embodiments of cantilevered, flapper-style valves, the cantilever distance may be selected to reduce the actuation power required to open the valves. For example, the distance between the cantilevered edge along which the flap is supported and the orifice in the valve seat may be selected to increase the lever arm with which the force of fluid pressure operates to open the valve. The reduction in fluid pressure may reduce the effort required by a wearer to open the valve when breathing, thus potentially reducing the wearer's fatigue.

The structure and benefits of the new exhalation valve may also be applied to an inhalation valve where the flow through the valve is likewise unidirectional.

In one aspect, the present invention may provide a filtering face mask that includes a filtering mask body that is adapted to fit at least over the nose and mouth of a wearer to create an interior gas space when worn. The filtering face mask may also include an exhalation valve that is in fluid communication with the interior gas space. The exhalation valve includes a valve seat having a seal surface and an orifice through which exhaled air may pass to leave the interior gas space, wherein the seal surface exhibits a hardness of 0.05 Gpa or higher. The exhalation valve may also include a monolayer flexible flap that is mounted to the valve seat such that a first major surface of the flap contacts the seal surface when the valve is in its closed position and such that the flap can flex away from the seal surface during an exhalation to allow exhaled air to pass through the orifice to ultimately enter an exterior gas space, wherein the flexible flap is unbiased when in the closed position, and wherein the flexible flap exhibits a cantilever bend ratio of 0.0050 or less.

In another aspect, the present invention may provide a filtering face mask that includes a mask body that is adapted to fit at least over the nose and mouth of a wearer to create an interior gas space when worn. The filtering face mask also includes an exhalation valve that is in fluid communication with the interior gas space. The exhalation valve includes a valve seat and flap. The valve seat has a rigid seal surface and an orifice through which exhaled air may pass to leave the interior gas space. The flexible flap is mounted to the valve seat such that a first major surface of the flap contacts the seal surface when the valve is in its closed position and such that the flap can flex away from the rigid seal surface during an exhalation to allow exhaled air to pass through the orifice to ultimately enter an exterior gas space, wherein the flexible flap is in the form of a monolayer structure and is unbiased when in the closed position, and wherein the flexible flap exhibits a cantilever bend ratio of 0.0050 or less.

GLOSSARY

The terms used to describe this invention will have the following meanings:

"cantilever bend ratio" means the ratio of deflection to cantilever length as defined in connection with the Cantilever Bend Ratio test described herein;

"clean air" means a volume of air or oxygen that has been filtered to remove contaminants or that otherwise has been made safe to breathe;

"closed position" means the position where the flexible flap is in full contact with the seal surface;

"contaminants" mean particles and/or other substances that generally may not be considered to be particles (e.g., organic vapors, et cetera) but may be suspended in air;

"exhaled air" is air that is exhaled by a filtering face mask wearer;

"exhale flow stream" means the stream of air that passes through an orifice of an exhalation valve during an exhalation;

"exhalation valve" means a valve that opens to allow a fluid to exit a filtering face mask's interior gas space;

"exterior gas space" means the ambient atmospheric gas space into which exhaled gas enters after passing through and beyond the exhalation valve;

"filtering face mask" means a respiratory protection device (including half and full face masks and hoods) that covers at least the nose and mouth of a wearer and that is capable of supplying clean air to a wearer;

"flexible flap" means a sheet-like article that is capable of bending or flexing in response to a force exerted from a moving fluid, which moving fluid, in the case of an exhalation valve, would be an exhale flow stream and in the case of an inhalation valve would be an inhale flow stream;

"flexural modulus" means the ratio of stress to strain for a material loaded in a bending mode. "inhale filter element" means a fluid-permeable structure through which air passes before being inhaled by a wearer of a filtering face mask so that contaminants and/or particles can be removed therefrom;

"inhale flow stream" means the stream of air or oxygen that passes through an orifice of an inhalation valve during an inhalation;

"inhalation valve" means a valve that opens to allow a fluid to enter a filtering face mask's interior gas space;

"interior gas space" means the space between a mask body and a person's face;

"juxtaposed" means placed side-by-side but not necessarily in contact with each other;

"mask body" means a structure that can fit at least over the nose and mouth of a person and that helps define an interior gas space separated from an exterior gas space;

"modulus of elasticity" means the ratio of the stress to the strain for the straight line portion of the stress/strain curve that is obtained by applying an axial load to a test specimen and measuring the load and deformation simultaneously through use of a tensile testing machine;

"monolayer" as used in connection with valve flaps means that the flap structure is substantially compositionally uniform throughout its volume, that is, the valve flap does not include two or more layers that exhibit different physical properties;

"particles" mean any liquid and/or solid substance that is capable of being suspended in air, for example, pathogens, bacteria, viruses, mucous, saliva, blood, etc.;

"resilient" means being able to recover if deformed in response to a flexural force and having a tensile modulus less than about 15 MegaPascals (MPa);

"rigid" as used to describe a seal surface means a seal surface with a hardness that is greater than 0.02 Giga Pascals (GPa);

"seal surface" means a surface that makes contact with the flexible flap when the valve is in its closed position;

"stiff or stiffness" means the flap's ability to resist deflection when supported horizontally as a cantilever by itself without support from other structures and exposed to gravity. A stiffer flap does not deflect as easily in response to gravity as a flap that is not as stiff;

"unidirectional fluid valve" means a valve that allows a fluid to pass through it in one direction but not the other;

"unbiased" as used in connection with a valve flap means that the flap is not pressed towards or against the seal surface by virtue of any mechanical force or internal stress that is placed on the flexible flap.

BRIEF DESCRIPTIONS OF THE FIGURES

DESCRIPTION OF EXEMPLARY EMBODIMENTS OF THE INVENTION

In the practice of the present invention, a new filtering face mask is provided that may improve wearer comfort and concomitantly make it more likely that users will continuously wear their masks in contaminated environments. The present invention thus may improve worker safety and provide long term health benefits to workers and others who wear personal respiratory protection devices.

Figure 1:
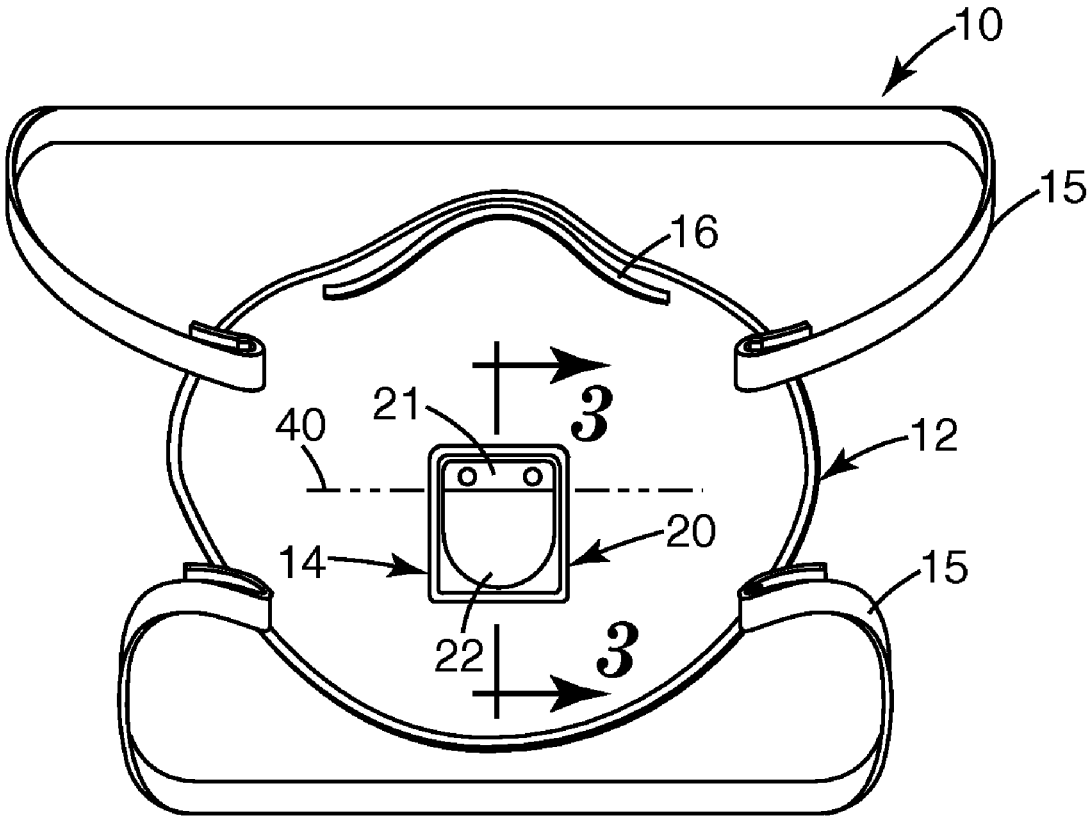
FIG. 1 is a front view of a filtering face mask 10 that may be used in connection with the present invention.

FIG. 1 illustrates an example of a filtering face mask 10 that may be used in conjunction with the present invention. Filtering face mask 10 has a cup-shaped mask body 12 onto which an exhalation valve 14 is attached. The valve may be attached to the mask body using any suitable technique, including, for example, the technique described in U.S. Pat. No. 6,125,849 to Williams et al. or in WO 01/28634 to Curran et al. The exhalation valve 14 opens in response to increased pressure inside the mask 10, which increased pressure occurs when a wearer exhales. The exhalation valve 14 preferably remains closed between breaths and during an inhalation. The valve 14 is depicted with the cover 50 (see FIG. 5) removed.

Mask body 12 is adapted to fit over the nose and mouth of a person in spaced relation to the wearer's face to create an interior gas space or void between the wearer's face and the interior surface of the mask body. The mask body 12 is fluid permeable and typically is provided with an opening (not shown) that is located where the exhalation valve 14 is attached to the mask body 12 so that exhaled air can exit the interior gas space through the valve 14 without having to pass through the mask body 12. The preferred location of the opening on the mask body 12 is directly in front of where the wearer's mouth would be when the mask is being worn. The placement of the opening, and hence the exhalation valve 14, at this location allows the valve to open more easily in response to the exhalation pressure generated by a wearer of the mask 10. For a mask body 12 of the type shown in this FIG. 1, essentially the entire exposed surface of mask body 12 is fluid permeable to inhaled air.

A nose clip 16 that comprises a pliable dead soft band of metal such as aluminum can be provided on mask body 12 to allow it to be shaped to hold the face mask in a desired fitting relationship over the nose of the wearer. An example of a suitable nose clip is shown in U.S. Pat. Nos. 5,558,089 and Des. 412,573 to Castiglione.

Mask body 12 can have a curved, hemispherical shape as shown in FIG. 1 (see also U.S. Pat. No. 4,807,619 to Dyrud et al.) or it may take on other shapes as so desired. For example, the mask body can be a cup-shaped mask having a construction like the face mask disclosed in U.S. Pat. No. 4,827,924 to Japuntich. The mask also could have the three-fold configuration that can fold flat when not in use but can open into a cup-shaped configuration when worn—see U.S. Pat. No. 6,123,077 to Bostock et al., and U.S. Pat. Nos. Des. 431,647 to Henderson et al., Des. 424,688 to Bryant et al. Face masks of the invention also may take on many other configurations, such as flat bifold masks disclosed in U.S. Pat. No. Des. 443,927 to Chen. The mask body also could be fluid impermeable and have filter cartridges attached to it like the mask shown in U.S. Pat. No. 5,062,421 to Burns and Reischel. In addition, the mask body also could be adapted for use with a positive pressure air intake as opposed to the negative pressure masks just described. Examples of positive pressure masks are shown in U.S. Pat. No. 5,924,420 to Grannis et al. and 4,790,306 to Braun et al. The mask body of the filtering face mask also could be connected to a self-contained breathing apparatus, which supplies clean air to the wearer as disclosed, for example, in U.S. Pat. Nos. 5,035,239 and 4,971,052. The mask body may be configured to cover not only the nose and mouth of the wearer (referred to as a "half mask") but may also cover the eyes (referred to as a "full face mask") to provide protection to a wearer's vision as well as to the wearer's respiratory system—see, for example, U.S. Pat. No. 5,924,420 to Reischel et al. The mask body may be spaced from the wearer's face, or it may reside flush or in close proximity to it. In either instance, the mask helps define an interior gas space into which exhaled air passes before leaving the mask interior through the exhalation valve. The mask body also could have a thermochromic fit-indicating seal at its periphery to allow the wearer to easily ascertain if a proper fit has been established—see U.S. Pat. No. 5,617,849 to Springett et al.

To hold the face mask snugly upon the wearer's face, mask body can have a harness such as straps 15, tie strings, or any other suitable means attached to it for supporting the mask on the wearer's face. Examples of mask harnesses that may be suitable are shown in U.S. Pat. Nos. 5,394,568, and 6,062,221 to Brostrom et al., and U.S. Pat. No. 5,464,010 to Byram.

Figure 2:
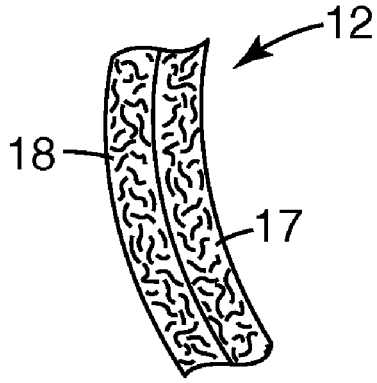
FIG. 2 is a partial cross section of the mask body 12 in FIG. 1.

FIG. 2 shows that the mask body 12 may include multiple layers such as an inner shaping layer 17 and an outer filtration layer 18. Shaping layer 17 provides structure to the mask body 12 and support for filtration layer 18. Shaping layer 17 may be located on the inside and/or outside of filtration layer 18 (or on both sides) and can be made, for example, from a nonwoven web of thermally-bondable fibers molded into a cup-shaped configuration—see U.S. Pat. No. 4,807,619 to Dyrud et al. and U.S. Pat. No. 4,536,440 to Berg. It can also be made from a porous layer or an open work "fishnet" type network of flexible plastic like the shaping layer disclosed in U.S. Pat. No. 4,850,347 to Skov. The shaping layer can be molded in accordance with known procedures such as those described in Skov or in U.S. Pat. No. 5,307,796 to Kronzer et al. Although a shaping layer 17 is designed with the primary purpose of providing structure to the mask and providing support for a filtration layer, shaping layer 17 also may act as a filter typically for capturing larger particles. Together layers 17 and 18 operate as an inhale filter element.

When a wearer inhales, air is drawn through the mask body, and airborne particles become trapped in the interstices between the fibers, particularly the fibers in the filter layer 18. In the mask shown in FIG. 2, the filter layer 18 is integral with the mask body 12—that is, it forms part of the mask body and is not an item that subsequently becomes attached to (or removed from) the mask body like a filter cartridge.

Filtering materials that are commonplace on negative pressure half mask respirators—like the mask 10 shown in FIG. 1—often contain an entangled web of electrically charged microfibers, particularly meltblown microfibers (BMF). Microfibers typically have an average effective fiber diameter of about 20 micrometers (μm) or less, but commonly are about 1 to about 15 μm, and still more commonly be about 3 to 10 μm in diameter. Effective fiber diameter may be calculated as described in Davies, C. N., *The Separation of Airborne Dust and Particles*, Institution of Mechanical Engineers, London, Proceedings 1B. 1952. BMF webs can be formed as described in Wente, Van A., *Superfine Thermoplastic Fibers* in Industrial Engineering Chemistry, vol. 48, pages 1342 et seq. (1956) or in Report No. 4364 of the Naval Research Laboratories, published May 25, 1954, entitled *Manufacture of Superfine Organic Fibers* by Wente, Van A., Boone, C. D., and Fluharty, E. L. When randomly entangled as a web, BMF webs can have sufficient integrity to be handled as a mat. Electric charge can be imparted to fibrous webs using techniques described in, for example, U.S. Pat. No. 5,496,507 to Angadjivand et al., U.S. Pat. No. 4,215,682 to Kubik et al., and U.S. Pat. No. 4,592,815 to Nakao.

Examples of fibrous materials that may be used as filters in mask bodies are disclosed in U.S. Pat. No. 5,706,804 to Baumann et al., U.S. Pat. No. 4,419,993 to Peterson, U.S. Reissue Pat. No. Re 28,102 to Mayhew, U.S. Pat. Nos. 5,472,481 and 5,411,576 to Jones et al., and U.S. Pat. No. 5,908,598 to Rousseau et al. The fibers may contain polymers such as polypropylene and/or poly-4-methyl-1-pentene (see U.S. Pat. Nos. 4,874,399 to Jones et al. and 6,057,256 to Dyrud et al.) and may also contain fluorine atoms and/or other additives to enhance filtration performance—see, U.S. patent application Ser. No. 09/109,497, entitled *Fluorinated Electret* (published as PCT WO 00/01737), and U.S. Pat. Nos. 5,025,052 and 5,099,026 to Crater et al., and may also have low levels of extractable hydrocarbons to improve performance; see, for example, U.S. Pat. No. 6,213,122 to Rousseau et al. Fibrous webs also may be fabricated to have increased oily mist resistance as described in U.S. Pat. No. 4,874,399 to Reed et al., and in U.S. Pat. Nos. 6,238,466 and 6,068,799, both to Rousseau et al.

A mask body 12 may also include inner and/or outer cover webs (not shown) that can protect the filter layer 18 from abrasive forces and that can retain any fibers that may come loose from the filter layer 18 and/or shaping layer 17. The cover webs also may have filtering abilities, although typically not nearly as good as the filtering layer 18 and/or may serve to make the mask more comfortable to wear. The cover webs may be made from nonwoven fibrous materials such as spun bonded fibers that contain, for example, polyolefins, and polyesters (see, for example, U.S. Pat. Nos. 6,041,782 to Angadjivand et al.), 4,807,619 to Dyrud et al., and 4,536,440 to Berg.

Figure 3:
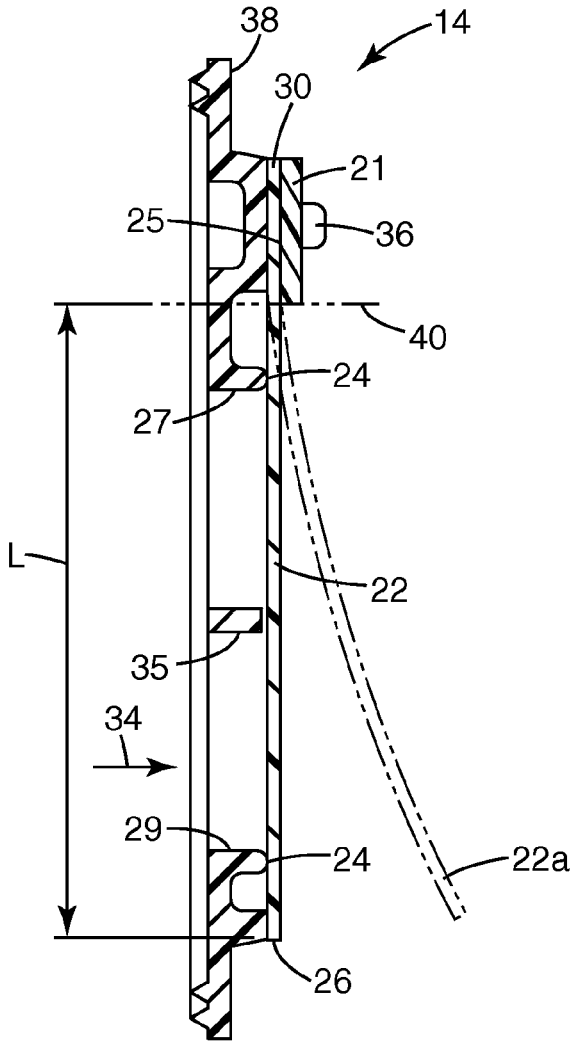
FIG. 3 is a cross-sectional view of an exhalation valve 14, taken along lines 3-3 of FIG. 1.

FIG. 3 shows that the flexible flap 22 rests on a seal surface 24 when the flap is closed and is also supported in cantilevered fashion to the valve seat 20 at a flap-retaining surface 25. The flap 22 lifts from the seal surface 24 at its free end 26 when a significant pressure is reached in the interior gas space during an exhalation. The seal surface 24 may lie in a plane such that a flat flexible flap 22 can rest on the planar seal surface 24 without being biased against the seal surface 24 under neutral conditions—that is, when a wearer is neither inhaling or exhaling.

When a wearer of a filtering face mask 10 exhales, the exhaled air commonly passes through both the mask body and the exhalation valve 14. Comfort is best obtained when the highest percentage of the exhaled air passes through the exhalation valve 14, as opposed to the filter media and/or shaping and cover layers in the mask body. Exhaled air is expelled from the interior gas space through an orifice 28 in valve 14 by having the exhaled air lift the flexible flap 22 from the seal surface 24. The circumferential or peripheral edge of flap 22 that is associated with a fixed or stationary portion 30 of the flap 22 remains essentially stationary during an exhalation, while the remaining free circumferential edge of flexible flap 22 is lifted from valve seat 20 during an exhalation.

The flexible flap 22 is secured at the stationary portion 30 to the valve seat 20 on the flap retaining surface 25, which surface 25 is disposed non-centrally relative to the orifice 28 and can have pins 36 to help mount and position the flap 22 on the valve seat 20. Flexible flap 22 can be secured to the surface 25 using sonic welding, an adhesive, mechanical clamping, and the like. A valve flap hold-down 21 aids in anchoring the flap 22 to the surface 25 and defines the stationary portion 30 of the flap 22. The valve seat 20 also has a flange 38 that extends laterally from the valve seat 20 at its base to provide a surface that allows the exhalation valve 14 to be secured to the mask body 12.

FIG. 3 shows the flexible flap 22 in a closed position resting on seal surface 24 and in an open position by the dotted lines 22*a*. A fluid passes through the valve 14 in the general direction indicated by arrow 34. If valve 14 was used on a filtering face mask to purge exhaled air from the mask interior, fluid flow 34 would represent an exhale flow stream. If valve 14 was used as an inhalation valve, flow stream 34 would represent an inhale flow stream. The fluid that passes through orifice 28 exerts a force on the flexible flap 22, causing the free end 26 of flap 22 to be lifted from seal surface 24 to make the valve 14 open. When valve 14 is used as an exhalation valve, the valve is preferably oriented on face mask 10 such that the free end 26 of flexible flap 22 is located below the secured end when the mask 10 is positioned upright as shown in FIG. 1. This enables exhaled air to be deflected downwards to prevent moisture from condensing on the wearer's eyewear.

The valves of the present invention may be characterized in terms of their cantilevered characteristics. The fixed or stationary portion 30 of the flap 22 that remains attached to the surface 25 of the valve seat 20 (as held in place by the flap hold-down 21 in the depicted embodiment) may define a cantilever edge 40 (see FIG. 1 also) past which the flap 22 is able to able to flex away from the valve seal surface 24 as seen in FIG. 3. The cantilever edge 40 may preferably be in the shape of a straight line to reduce the force required to open the valve flap 22 (as opposed to a cantilever edge that is curved). If, for example, the pins 36 are used to secure the flap 22 on valve seat 20, the cantilever edge 40 may be defined by the edge of the hold-down 21 as seen in FIGS. 1 & 3. Other techniques of attaching the flap 22 to the valve seat 20 may result in locating the cantilever edge 40 at a different position relative to the valve seat 20.

The flexible flap 22 has a beam length L that extends generally perpendicular to the cantilever edge 40. The distance along the beam length L between the proximal edge 27 and the cantilever edge 40 is less than the distance along the beam length L between the distal edge 29 and the cantilever edge 40.

It may be preferred that the ratio of the distance along the beam length L between the proximal edge 27 and the cantilever edge 40 as compared to the distance along the beam length L between the distal edge 29 and the cantilever edge 40 be 1:5 or more, in some embodiments 2:5 or more. As the ratio of the distances between the cantilever edge 40 and each of the proximal edge 27 and distal edge 29 increases, the fluid pressure required to open the flap 22 may decrease because of the larger lever arm. This reduction in fluid pressure may reduce the effort required by a wearer to open the valve when breathing, thus potentially reducing the wearer's fatigue.

Figure 4:
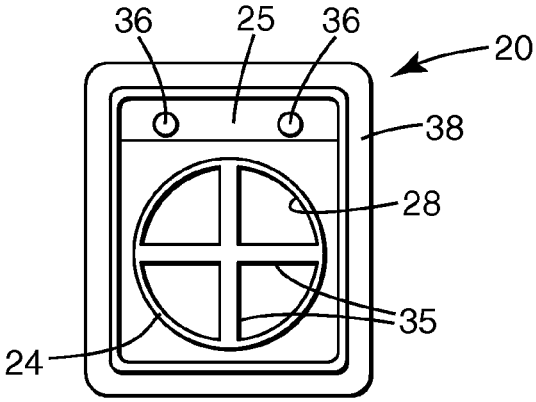
FIG. 4 is a front view of a valve seat 20 that may be used in conjunction with the present invention.

FIG. 4 shows the valve seat 20 from a front view without a flap being attached to it. The valve orifice 28 is disposed radially inward from the seal surface 24 and can have cross members 35 that stabilize the seal surface 24 and ultimately the valve 14. The cross members 35 also can prevent flap 22 (FIG. 3) from inverting into orifice 28 during an inhalation. Moisture build-up on the cross members 35 can hamper the opening of the flap 22. Therefore, the surfaces of the cross-members 35 that face the flap preferably are slightly recessed beneath the seal surface 24 when viewed from a side elevation to not hamper valve opening.

The seal surface 24 circumscribes or surrounds the orifice 28 to prevent the undesired passage of contaminates through it. Seal surface 24 and the valve orifice 28 can take on essentially any shape when viewed from the front. For example, the seal surface 24 and the orifice 28 may be square, rectangular, circular, elliptical, etc., or a combination of such shapes (see, for example, the shapes shown in U.S. Pat. Nos. 5,325,892 and 5,509,436 to Japuntich et al. and in U.S. patent application Ser. Nos. 09/888,943 and 09/888,732 to Mittelstadt et al.) The shape of seal surface 24 does not have to correspond to the shape of orifice 28 or vise versa. For example, the orifice 28 may be circular and the seal surface 24 may be rectangular. The seal surface 24 and orifice 28, however, preferably have a circular cross-section when viewed against the direction of fluid flow.

Valve seat 20 may preferably be made from a relatively lightweight plastic that is molded into an integral one-piece body. The valve seat 20 can be made by injection molding techniques. The seal surface 24 that makes contact with the flexible flap 22 is preferably fashioned to be substantially uniformly smooth to ensure that a good seal occurs and may reside on the top of a seal ridge. The contact surface 24 preferably has a width great enough to form a seal with the flexible flap 22 but is not so wide as to allow adhesive forces caused by condensed moisture to make the flexible flap 22 significantly more difficult to open. The width of the seal or contact surface, preferably, is at least 0.2 mm, and preferably is about 0.25 mm to 0.5 mm. The valve 14 and its valve seat 20 shown in FIGS. 1, 3 and 4 are more fully described in U.S. Pat. Nos. 5,509,436 and 5,325,892 to Japuntich et al.

Seal surfaces that are used in conjunction with valves in filtering face masks of the present invention are preferably rigid, that is, they preferably have a hardness of more than 0.02 GPa. It may be preferred that the rigid seal surfaces be constructed of materials that exhibit a hardness of 0.05 GPa or higher. The hardness may be determined in accordance with the "Nanoindentation Technique" set forth herein. The rigid seal surface may be formed as an integral part of the valve seat. Alternatively, a rigid valve seat meeting the hardness requirements discussed herein could be attached to a valve seat using essentially any technique suitable for doing so, such as adhering, bonding, welding, frictionally engaging, etc. The seal surface may be in the form of a coating, a film, a ring, etc.

It may be preferred that the valve seat 20 and seal surface 24 be formed as an integral unit from a relatively lightweight plastic that is molded into an integral one-piece body using, for example, injection molding techniques and the resilient seal surface would be joined to it. The seal surface 24 that makes contact with the flexible flap 22 is preferably fashioned to be substantially uniformly smooth to ensure that a good seal occurs. The seal surface 24 may reside on the top of a seal ridge 29 or it may be in planar alignment with the valve seat itself. The contact area of the seal surface 24 preferably has a width great enough to form a seal with the flexible flap 22 but is not so wide as to allow adhesive forces—caused by condensed moisture or expelled saliva—make the flexible flap 22 significantly more difficult to open. The seal surface 24 may preferably be curved in a concave manner where the flap makes contact with the seal surface to facilitate contact of the flap to the seal surface around the whole perimeter of the seal surface.

Figure 5:
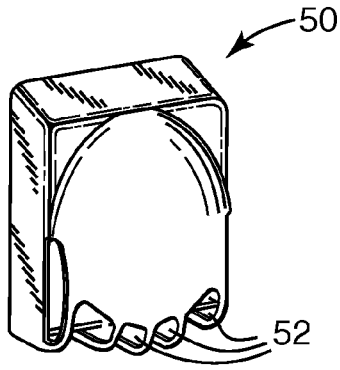
FIG. 5 is a perspective view of a valve cover 50 that may be used to protect an exhalation valve.

FIG. 5 shows a valve cover 50 that may be suitable for use in connection with the exhalation valves shown in the other figures. The valve cover 50 defines an internal chamber into which the flexible flap can move from its closed position to its open position. The valve cover 50 can protect the flexible flap from damage and can assist in directing exhaled air downward away from a wearer's eyeglasses. As shown, the valve cover 50 may possess a plurality of openings 52 to allow exhaled air to escape from the internal chamber defined by the valve cover. Air that exits the internal chamber through the openings 52 enters the exterior gas space, downwardly away from a wearer's eyewear.

In addition to use as an exhalation valve, the present invention is likewise suitable for use in conjunction with an inhalation valve. Like an exhalation valve, an inhalation valve also is a unidirectional fluid valve that provides for fluid transfer between an exterior gas space and an interior gas space. Unlike an exhalation valve, however, an inhalation valve allows air to enter the interior of a mask body. An inhalation valve thus allows air to move from an exterior gas space to the interior gas space during an inhalation.

Inhalation valves are commonly used in conjunction with filtering face masks that have filter cartridges attached to them. The valve may be second to either the filter cartridge or to the mask body. In any case, the inhalation valve is preferably disposed in the inhale flow stream downstream to where the air has been filtered or otherwise has been made safe to breathe. Examples of commercially available masks that include inhalation valves are the 5000™ and 6000™ Series respirators sold by the 3M Company. Patented examples of filtering face masks that use an inhalation valve are disclosed in U.S. Pat. No. 5,062,421 to Burns and Reischel, U.S. Pat. No. 6,216,693 to Rekow et al., and in U.S. Pat. No. 5,924,420 to Reischel et al. (see also U.S. Pat. Nos. 6,158,429, 6,055,983, and 5,579,761). While the inhalation valve could take, for example, the form of a button-style valve, alternatively, it could also be a flapper-style valve like the valve shown in FIGS. 1, 3, 4, and 5. To use the valve shown in these figures as an inhalation valve, it merely needs to be mounted to the mask body in an inverted fashion so that the flexible flap 22 lifts from the seal surface 24 during an inhalation rather than during an exhalation. The flap 22 thus, would be pressed against the seal surface 24 during an exhalation rather than an inhalation. An inhalation valve of the present invention could similarly improve wearer comfort by reducing the power needed to operate the inhalation valve while breathing.

As discussed herein, a flexible flap that is constructed for use in a fluid valve of the invention includes a sheet that is adapted for attachment to a valve seat of a fluid valve. The flexible flap can bend dynamically in response to a force from a moving gaseous flowstream and can readily return to its original position when the force is removed.

It may be preferred that at least the portions of the flexible flaps of the present invention be in the form of flat sheets such that the major surfaces of the flaps that span the seal surfaces are also flat. As used herein, the term "flat sheet" does not include flaps with structural features (such as, for example, raised ribs) that extend above the remainder of the major surface of the flap. It may further be preferred that the entire flap be constructed as a flat sheet of material, including those portions of the flap that are located outside of the seal surfaces.

As discussed herein, the flexible flaps of valves according to the present invention are unbiased, that is, the flaps are not pressed towards or against the seal surface by virtue of any mechanical force or internal stress that is placed on the flexible flap. Because the flaps are not biased towards the seal surface under neutral conditions (that is, when no fluid is passing through the valve or the flap is not otherwise subjected to external forces), the flap may open more easily during an exhalation than a valve in which the flap is biased against a seal surface. The unbiased valve flaps may preferably not undergo creep after storage for long periods of time.

To assist in retaining the flexible flap in the closed position (that is, against the seal surface) when not subjected to fluid pressure during exhalation, the flexible flaps of the present invention are preferably constructed of stiffer materials than may commonly be used in biased valves. The resulting stiffer (but still flexible) flap preferably does not significantly droop away from the seal surface when a force of gravity is exerted upon the flap (and no fluid pressure is operating to open the flap). The unidirectional valves thus can be fashioned so that the flaps make good contact with the seal surfaces under any orientation, including when a wearer bends their head downward towards the floor, without having the flaps biased towards the seal surface. A flexible flap of the present invention, therefore, may make hermetic-type contact with the seal surface under any orientation of the valve with no significant pre-stress or bias towards the valve seat's seal surface. The lack of significant predefined stress or force on the flap may enable the flap to open more easily during an exhalation and hence can reduce the power needed to operate the valve while breathing.

The materials used to construct the flaps of the present invention are preferably materials that, while stiff, will deform elastically over the actuation range of the flexible flap. The flaps are in the form of monolayer structures in which the flap structure is substantially compositionally uniform throughout its volume, that is, the valve flap does not include two or more layers that exhibit different physical properties. The monolayer flaps may be constructed of only one material such that the flap consists essentially of only one material. Alternatively, the flaps may include two or more different materials dispersed throughout the bulk of the flap structure such that the composition of the flap is uniform (except for minor compositional variations due to manufacturing). Such monolayer flaps may be distinguished from, for example, the multilayer flap structures described in US Patent Application Publication No. US 2005/0061327.

The modulus of elasticity of the materials used in the flexible flaps may be a factor in designing a flexible flap according to the invention. As indicated above, the "modulus of elasticity" is the ratio of the stress-to-strain for the straight-line portion of the stress-strain curve, which curve is obtained by applying an axial load to a test specimen and measuring the load and deformation simultaneously. Typically, a test specimen is loaded uniaxially and load and strain are measured, either incrementally or continuously. The modulus of elasticity for materials employed in the invention may be obtained using a standardized ASTM test. The ASTM tests employed for determining elastic or Young's modulus are defined by the type or class of material that is to be analyzed under standard conditions. A general test for structural materials is covered by ASTM E111-97 and may be employed for structural materials in which creep is negligible, compared to the strain produced immediately upon loading and to elastic behavior. The standard test method for determining tensile properties of plastics is described in ASTM D638-01 and may be employed when evaluating unreinforced and reinforced plastics. If a vulcanized thermoset rubber or thermoplastic elastomer is selected for use in the invention, then standard test method ASTM D412-98a, which covers procedures used to evaluate the tensile properties of these materials, may be employed.

Flexural modulus is another property that may be used to define the material used in the layers of the flexible flap. For plastics, flexural modulus may be determined in accordance with standardized test ASTM D747-99.

Modulus values convey intrinsic material properties and not precisely-comparable composition properties. This is especially true when dissimilar classes of materials are employed in a flap. If different classes of materials are employed in a flap, then the skilled artisan will need to select the test that is most appropriate for the combination of materials. For example, if a flap contains a ceramic powder (a discontinuous phase) in a polymer (a continuous phase or matrix), the ASTM test for plastics would probably be the more suitable test method if the plastic portion was the continuous phase in the flap.

The flexible flap may preferably be constructed from a material that has a modulus of elasticity that is preferably about 0.7 MPa or higher, more preferably about 0.8 MPa or higher, and potentially more preferably about 0.9 MPa or higher. At the upper end of the range, it may be preferred that the modulus of elasticity of the material used for the flap be about 20 MPa or less, more preferably about 15 MPa or less, potentially more preferably about 13 MPa or less.

The flexible flap's overall thickness may typically be about 250 micrometers (μm) or higher, more preferably about 500 μm or higher, and potentially more preferably about 600 μm or higher. At the upper end of the range, it may be preferred that the flap thickness be about 3500 μm or less, more preferably about 3000 μm or less, and more preferably about 2800 μm or less.

The combination of modulus of elasticity of the valve flaps and their thickness may preferably provide valve flaps used in connection with the present invention with relatively low Cantilever Bend Ratios (see the discussion herein regarding the Cantilever Bending Ratio Test). It may be preferred that the valve flaps of the present invention, although flexible, exhibit cantilever bend ratios of about 0.0050 or less, more preferably about 0.0025 or less, and potentially more preferably about 0.0015 or less.

The exhalation valve that is described in U.S. Pat. Nos. 5,325,892 and 5,509,436 to Japuntich et al. is believed to be a superior performing commercially available exhalation valve for use on a filtering face masks. Valves of the present invention, however, may be capable of exceeding the acceptable performance criteria for leak rate, valve opening pressure drop, and pressure drop across the valve under various flow rates. These parameters may be measured using the Leak Rate Test and Pressure Drop Test described below.

The Leak Rate is a parameter that measures the ability of the valve to remain closed under neutral conditions. The Leak Rate test is described below in detail but generally measures the amount of air that can pass through the valve at an air pressure differential of 1 inch water (249 Pa). Leak rates range from 0 to 30 cubic centimeters per minute ($cm^3$/min) at 249 Pa pressure, with lower numbers indicating better sealing. Using a filtering face mask of the present invention, leak rates that are less than or equal to 30 $cm^3$/min can be achieved in accordance with the present invention. Preferably, leak rates less than 10 $cm^3$/min may also be achieved.

Examples of some potentially suitable materials from which the seal surface may be made include highly crystalline materials such as ceramics, diamond, glass, zirconia; metals/foils from materials such as boron, brass, magnesium alloys, nickel alloys, stainless steel, steel, titanium, and tungsten. Polymeric materials that may be suitable include thermoplastics such as copolyester ether, ethylene methyl acrylate polymer, polyurethane, acrylonitrile-butadiene styrene polymer, high density polyethylene, high impact polystyrene, linear low density polyethylene, polycarbonate, liquid crystal polymer, low density polyethylene, melamines, nylon, polyacrylate, polyamide-imide, polybutylene terephthalate, polycarbonate, polyetheretherketone, polyetherimide, polyethylene napthalene, polyethylene terephthalate, polyimide, polyoxymethylene, polypropylene, polystyrene, polyvinylidene chloride, and polyvinylidene fluoride. Naturally-derived cellulosic materials such as reed, paper, and woods like beech, cedar, maple, and spruce may also be useful. Blends, mixtures, and combinations of these materials may too be used.

Examples of some potentially suitable commercially available materials for the seal surface may include:

TABLE 1

| Polymer Type | Source | Product Designator | Published Elastic Modulus (MPa) |
|---|---|---|---|
| Nylon 11 | Elf Atochem, Philadelphia, PA | Besno P40 TL | 320 |
| Nylon 11 | Elf Atochem, Philadelphia, PA | Besno TL | 1300 |
| Copolyester Ether | Eastman Chemical Co., Kingsport, TN | Ecdel 9966 | 110 |
| Ethylene-Methyl Acrylate Copolymer | Eastman Chemical Co., Kingsport, TN | EMAC SP2220 | |
| Polycarbonate | Bayer AG, Pittsburgh, PA | Makrolon 3108 | 2413 |
| Poly (ethylene terephthalate) | E. I. Dupont Co., Wilmington, DE | Mylar 50 CL | 3790 |
| Polypropylene | Atofina, Deerpark, TX | Polypropylene 3576 | |

It may be preferred that flexible flaps be made from resilient polymeric materials. As the term is used in this document, "polymeric" means containing a polymer, which is a molecule that contains repeating units, regularly or irregularly arranged. The polymer may be natural or synthetic and preferably is organic. Resilient polymeric materials may include elastomers, thermoset and thermoplastic, and plastomers, or blends thereof The polymeric materials in the flexible flaps may or may not be oriented, either in their entireties or in part.

Elastomers, which may be either thermoplastic elastomers or crosslinked rubbers, may include rubber materials such as polyisoprene, poly (styrene-butadiene) rubber, polybutadiene, butyl rubber, ethylene-propylene-diene rubber, ethylene-propylene rubber, nitrile rubber, polychloroprene rubber, chlorinated polyethylene rubber, chlorosulphonated polyethylene rubber, polyacrylate elastomer, ethylene-acrylic rubber, fluorine containing elastomers, silicone rubber, polyurethane, epichlorohydrin rubber, propylene oxide rubber, polysulphide rubber, polyphosphazene rubber, and latex rubber, styrene-butadiene-styrene block copolymer elastomer, styrene-ethylene/butylene-styrene block copolymer elastomer, styrene-isoprene-styrene block copolymer elastomer, ultra low density polyethylene elastomer, copolyester ether elastomer, ethylene methyl acrylate elastomer ethylene vinyl acetate elastomer, and polyalphaolefin elastomers. Blends or mixtures of these materials may also be used. Materials that may be blended with those discussed above may include, for example, polymers, fillers, additives, stabilizers, and the like.

Examples of some commercially available elastomeric polymeric materials that may be suitable for use in the flexible flaps of the invention are:

TABLE 2

| Polymer Type | Source | Product Designator | Published Elastic Modulus (MPa) |
|---|---|---|---|
| Nitrile Rubber | Rubber Industries, Inc., Shakopee, MN | 4904 Nitrile Black | |
| Ethylene Vinyl Acetate Copolymer | E. I. Dupont Co., Wilmington, DE | Elvax 260 | |
| Ethylene-Methyl Acrylate Copolymer | Eastman Chemical Co., Kingsport, TN | EMAC SP2220 | |
| Polyethylene | Dupont/Dow Elastomers, Wilmington, DE | Engage 8200 | 2.76 @ 100% elongation |
| Polyethylene | Dupont/Dow Elastomers, Wilmington, DE | Engage 8550 | |
| Styrene-Butadiene-Styrene block copolymer | Atofina, Houston, TX | Finaprene 502 | |
| Styrene-Ethylene/Butylene-Styrene block copolymer | Kraton Elastomers, Belpre, Ohio | Kraton G1657 | 2.41 @ 300% Elongation |
| Thermoplastic elastomer | QST Inc., St. Albans, VT | Monprene 1504 | 2.76 @ 300% Elongation |
| Thermoplastic elastomer | Advanced Elastomers, Akron, Ohio | Santoprene 121-58 W175 | 2.1 @ 100% Elongation |
| Ionomer Resin | E. I. Dupont Co., Wilmington, DE | Surlyn 1650 | |
| Thermoplastic elastomer | Advanced Elastomers, Akron, Ohio | Vistaflex 641 | 1.6 @ 100% Elongation |

Elongations percentages were selected to best match the flattened portion of the stress-strain curve for a given material.

Flexible flaps that are used in connection with the present invention may be made through any suitable process, such as, for example, extruding, electroplating, injection molding, casting, solvent coating, vapor deposition, etc.

The following Example has been selected for presentation here merely to further illustrate particular features and details of the invention. It is to be expressly understood, however, that while the Example serves this purpose, the particular details, ingredients, and other features are not to be construed in a manner that would unduly limit the scope of this invention.

TEST APPARATUS, TEST METHODS AND EXAMPLE

Flow Fixture:

Pressure drop testing is conducted on the valve with the aid of a flow fixture. The flow fixture provides air, at specified flow rates, to the valve through an aluminum mounting plate and an affixed air plenum. The mounting plate receives and securely holds a valve seat during testing. The aluminum mounting plate has a slight recess on its top surface that received the base of valve. Centered in the recess is a 19.3 millimeter (mm) circular opening through which air can flow to the valve. Adhesive-faced foam material may be attached to the ledge within the recess to provide an airtight seal between the valve and the plate. A weighted clamp is used to capture and secure the left and right edge of the valve seat to the aluminum mount. Air is provided to the mounting plate through a hemispherical-shaped plenum. The mounting plate is affixed to the plenum at the top or apex of the hemisphere to mimic the cavity shape and volume of a respiratory mask. The hemispherical-shaped plenum is approximately 30 mm deep and has a base diameter of 80 mm. Air from a supply line is attached to the base of the plenum and is regulated to provide the desired flow through the flow fixture to the valve. For an established air flow, air pressure within the plenum is measured to determine the pressure drop over the test valve.

Cantilever Bending Ratio:

A cantilever bending test was used to indicate stiffness of thin strips of material by measuring the bending length of a specimen under its own mass. A test specimen was prepared by cutting the 0.794 cm wide strips of material to approximately 5 cm lengths. The specimen was slid, in a direction parallel to its long dimension, over the 90° edge of a horizontal surface. After 1.5 cm of material was extended past the edge (the extended length), the deflection of the specimen was measured as the vertical distance from the lowermost edge at the end of the strip to the horizontal surface. The deflection of the specimen divided by its extended length was reported as the cantilever bend ratio. A cantilever bend ratio approaching one (1) would indicate a higher level of flexibility than a cantilever bend ratio that approaches zero.

Leak Rate Test

Leak rate testing for exhalation valves is generally as described in 42 CFR §82.204. This leak rate test is suitable for valves that have a flexible flap mounted to the valve seat. In conducting the Leak Rate Test, the valve seat is sealed between the openings of two ported air chambers. The two air chambers are configured so that pressurized air that is introduced into the lower chamber flows up through the valve into the upper chamber. The lower air chamber is equipped so that their internal pressures can be monitored during testing. An air flow gauge is attached to the outlet port of the upper chamber to determine air flow through the chamber. During testing, the valve is sealed between the two chambers and is horizontally oriented with the flap facing the lower chamber. The lower chamber is pressurized via an air line to cause a pressure differential, between the two chambers, of 249 Pa (25 mm $H_2O$; 1 inch $H_2O$). This pressure differential is maintained throughout the test procedure. Outflow of air from the upper chamber is recorded as the leak rate of the test valve. Leak rate is reported as the flow rate, in liters per minute, which results when an air pressure differential of 249 Pa is applied over the valve.

Hardness Measurement:

A Nanoindentation Technique was employed to determine hardness of materials used in valve seats. The Nanoindentation Technique permitted testing of either raw material specimens, for use in valve seat applications, or valve seats as they were incorporated as part of a valve assembly. This test was carried out using a microindentation device, MTS Nano XP Micromechanical Tester available from MTS Systems Corp., Nano Instruments Innovation Center 1001 Larson Drive, Oak Ridge Tenn., 37839. Using this device, the penetration depth of a Berkovich pyramidal diamond indenter, having a 65 degree included half cone angle was measured as a function of the applied force, up to the maximum load. The nominal loading rate was 10 nanometers per second (nm/s) with a surface approach sensitivity of 40% and a spatial drift setpoint set at 0.8 nm/s maximum. Constant strain rate experiments to a depth of 5,000 nm were used for all tests with the exception of fused silica calibration standards, in which case a constant strain rate to a final load of 100,000 micro Newtons was used. Target values for the strain rate, harmonic displacement, and Poissons Ratio were 0.05 $sec^{-1}$, 45 Hertz, and 0.4, respectively. With the test specimen fixed in a holder, the target surface to be tested was located from a top-down view through a video screen of the device. The test regions were selected locally with 100× video magnification of the test apparatus to ensure that tested regions are representative of the desired sample material, that is, free of voids, inclusions, or debris. In the test procedure, one test is conducted for the fused quartz standard for each experimental run as a 'witness'. Axis alignment between the microscope optical axis and the indenter axis is checked and calibrated previous to testing by an iterative process where test indentations are made into a fused quartz standard, with error correction provided by software in the test apparatus. The test system was operated in a Continuous Stiffness Measurement (CSM) mode. Hardness, reported in Mega Pascals (MPa), is defined as the threshold contact stress for the onset of plastic flow of the specimen and is given as:

$$\boxed{H = \frac{P}{A}}$$

$H$ = Hardness $P$ = Load $A$ = Contact Area

EXAMPLE 1

A flexible flap was formed from a sheet of nitrile rubber (1.969 mm thick, 60Shore A hardness) by die cutting the sheet to create a rectangular portion that had a semi-circular end (see FIG. 1, item 22). The overall length of the die-cut flap, including the semi-circular end, was about 3.1 cm, and the width of the flap was about 2.3 cm. The semi-circular end of the flap, in plan section, had a radius of 1.27 cm.

When measured according to the Cantilever Bending Ratio test described herein, the flap exhibited a deflection (d) of 25.4 micrometers with an extended length (L) of 2.14 cm for a d/L ratio of 0.0011.

To evaluate the leak rate performance of a valve incorporating this flap, the rectangular end of the flap was secured to a valve seat in a valve body using a flap hold-down with a length of 0.955 cm and a width that was coextensive with the flap width. The valve body had a valve seat that was flat or planar when viewed from a side elevation.

The configuration of the valve seat is a modified version of the valve seats described generally in U.S. Pat. Nos. 5,325,892 and 5,509,436 to Japuntich et al. It is similar to that used in a valve body employed in a commercially available face mask, Model 8511, available from 3M Company (St. Paul, Minn.) except that the valve seat is flat, not curved, when viewed from the side. The valve body had a circular orifice of 3.0 square centimeters ($cm^2$) disposed within the valve seat, with an open area of 2.64 $cm^2$. To assemble a valve for evaluation, the valve flap was clamped to a flap-retaining surface that was about 5.65 millimeters (mm) long using a flap hold-down that extended from the rear of the flap towards its free end for a distance of 0.955 cm and that traversed the valve seat for a distance of about 25 mm. The curved seal ridge had a width of about 0.51 mm. The flexible flap remained in an abutting relationship to the seal ridge under neutral conditions, no matter how the valve was oriented. No valve cover was attached to the valve seat.

When tested according to the Leak Rate Test described herein, the valve exhibited a leak rate of 7.5 cubic centimeters per minute (cc/min).

All of the patents, patent applications, and other documents cited above, including those in the Background section, are incorporated by reference into this document in total.

The present invention may be suitably practiced in the absence of any element not specifically described in this document.

The invention claimed is:

1. A filtering face mask that comprises:

(a) a filtering mask body that is adapted to fit at least over the nose and mouth of a wearer to create an interior gas space when worn; and (b) an exhalation valve that is in fluid communication with the interior gas space, the exhalation valve comprising:

(i) valve seat that comprises a seal surface and an orifice through which exhaled air may pass to leave the interior gas space, wherein the seal surface exhibits a hardness of 0.05 Gpa or higher; and (ii) a monolayer flexible flap that is mounted to the valve seat such that a first major surface of the flap contacts the seal surface when the valve is in its closed position and such that the flap can flex away from the seal surface during an exhalation to allow exhaled air to pass through the orifice to ultimately enter an exterior gas space, wherein the flexible flap is unbiased when in the closed position, and wherein the flexible flap exhibits a cantilever bend ratio of 0.0050 or less.

2. The filtering face mask of claim 1, wherein the flexible flap exhibits a cantilever bend ratio of 0.004 or less.

3. The filtering face mask of claim 1, wherein the flexible flap is attached to the valve seat along a cantilever edge, the flexible flap comprising a beam length extending generally perpendicular to the cantilever edge, and wherein the orifice comprises a distal edge and a proximal edge located along the beam length, wherein a first distance along the beam length between the proximal edge and the cantilever edge is less than a second distance along the beam length between the distal edge and the cantilever edge, and further wherein a ratio of the first distance to the second distance is 1:5 or more.

4. The filtering face mask of claim 3, wherein the ratio of the first distance to the second distance is 2:5 or more.

5. The filtering face mask of claim 1, wherein the flexible flap consists essentially of one material.

6. The filtering face mask of claim 5, wherein the material comprises a modulus of elasticity of about 0.7 to about 20 MegaPascals.

7. The filtering face mask of claim 1, wherein the portion of the flexible flap located over the seal surface and orifice is in the form of a flat sheet.

8. The filtering face mask of claim 1, wherein the exhalation valve is mounted to the mask body.

9. The filtering face mask of claim 1, wherein the filtering mask is a negative pressure half-mask comprising a fluid-permeable mask body that comprises a layer of filter material.

10. The filtering face mask of claim 1, wherein the seal surface comprises a planar seal surface.

11. A filtering face mask that comprises:

(a) a mask body that is adapted to fit at least over the nose and mouth of a wearer to create an interior gas space when worn; and (b) an exhalation valve that is in fluid communication with the interior gas space, the exhalation valve comprising:

(i) a valve seat that comprises a rigid seal surface and an orifice through which exhaled air may pass to leave the interior gas space; and (ii) a flexible flap that is mounted to the valve seat such that a first major surface of the flap contacts the seal surface when the valve is in its closed position and such that the flap can flex away in from the rigid seal surface during an exhalation to allow exhaled air to pass through the orifice to ultimately enter an exterior gas space, wherein the flexible flap is in the form of a monolayer structure and is unbiased when in the closed position, and wherein the flexible flap exhibits a cantilever bend ratio of 0.0050 or less.

12. The filtering face mask of claim 11, wherein the flexible flap exhibits a cantilever bend ratio of 0.004 or less.

13. The filtering face mask of claim 11, wherein the seal surface exhibits a hardness of 0.05 Gpa or higher.

14. The filtering face mask of claim 11, wherein the flexible flap is attached to the valve seat along a cantilever edge, the flexible flap comprising a beam length extending generally perpendicular to the cantilever edge, and wherein the orifice comprises a distal edge and a proximal edge located along the beam length, wherein a first distance along the beam length between the proximal edge and the cantilever edge is less than a second distance along the beam length between the distal edge and the cantilever edge, and further wherein a ratio of the first distance to the second distance is 1:5 or more.

15. The filtering face mask of claim 14, wherein the ratio of the distance to the second distance is 2:5 or more.

16. The filtering face mask of claim 11, wherein the flexible flap consists essentially of one material.

17. The filtering face mask of claim 16, wherein the material comprises a modulus of elasticity of about 0.7 to about 20 MegaPascals.

18. The filtering face mask of claim 11, wherein the portion of the flexible flap located over the seal surface and orifice is in the form of a flat sheet.

19. The filtering face mask of claim 11, wherein the exhalation valve is mounted to the mask body.

20. The filtering face mask of claim 11, wherein the filtering mask is a negative pressure half-mask comprising a fluid-permeable mask body that comprises a layer of filter material.

21. The filtering face mask of claim 11, wherein the seal surface comprises a planar seal surface.

* * * * *

UNITED STATES PATENT AND TRADEMARK OFFICE

CERTIFICATE OF CORRECTION

PATENT NO. : 7,503,326 B2
APPLICATION NO. : 11/275299
DATED : March 17, 2009
INVENTOR(S) : Philip G. Martin It is certified that error appears in the above-identified patent and that said Letters Patent is hereby corrected as shown below:

Column 13
Line 41, delete “thereof” and insert -- thereof. --, therefor.

Column 14
Line 48, after “METHODS” insert -- , --.

Column 16
Line 31, delete “60Shore” and insert -- 60 Shore --, therefor.

Column 17
Line 14, in Claim 1, delete “valve” and insert -- a valve --, therefor.
Line 52, in Claim 9, after “filtering” insert -- face --.

Column 18
Line 15, in Claim 11, after “away” delete “in”.
Line 37, in Claim 15, delete “the distance” and insert -- the first distance --, therefor.
Lines 48-49, in Claim 20, after “filtering” insert -- face --.

Signed and Sealed this

Sixteenth Day of June, 2009

JOHN DOLL
*Acting Director of the United States Patent and Trademark Office*